US006748603B1

(12) United States Patent
Schmitt et al.

(10) Patent No.: US 6,748,603 B1
(45) Date of Patent: Jun. 15, 2004

(54) DISPOSABLE GLOVE

(76) Inventors: Allan C. Schmitt, 10247 Twin Hill Rd., Wexford, PA (US) 15090; Edward Scott Carlson, 227 Rose Ct., North Delmont, PA (US) 15626

( * ) Notice: Subject to any disclaimer, the term of this patent is extended or adjusted under 35 U.S.C. 154(b) by 0 days.

(21) Appl. No.: 10/308,250

(22) Filed: Dec. 2, 2002

(51) Int. Cl.[7] ..... A41D 19/00
(52) U.S. Cl. ..... 2/159; 294/1.3
(58) Field of Search ..... 2/16, 20, 158, 2/159, 160, 161.6, 161.7, 161.8, 162, 163, 164, 167, 168; 15/104.94; 602/21, 22; 294/1.3

(56) References Cited

U.S. PATENT DOCUMENTS

| | | | | | |
|---|---|---|---|---|---|
| 4,788,733 | A | * | 12/1988 | Lerner | 15/104.94 |
| 4,902,283 | A | * | 2/1990 | Rojko et al. | 604/290 |
| 4,937,881 | A | * | 7/1990 | Heise | 2/16 |
| 5,186,322 | A | * | 2/1993 | Harreld et al. | 206/216 |
| 5,438,708 | A | * | 8/1995 | Jacovitz | 2/161.6 |
| 5,704,670 | A | * | 1/1998 | Surplus | 294/25 |
| 5,740,554 | A | * | 4/1998 | Reed | 2/158 |
| 6,050,726 | A | * | 4/2000 | Hoerl | 383/127 |
| 6,116,668 | A | * | 9/2000 | Carpol | 294/1.3 |
| 6,237,971 | B1 | * | 5/2001 | Ward Gilley | 294/1.3 |
| 6,511,111 | B2 | * | 1/2003 | Dooley | 294/1.3 |

FOREIGN PATENT DOCUMENTS

| | | | | |
|---|---|---|---|---|
| FR | 2 649 143 | * | 4/1990 | E01H/1/12 |

* cited by examiner

*Primary Examiner*—Gary L. Welch
(74) *Attorney, Agent, or Firm*—James Ray & Associates

(57) ABSTRACT

A glove designed to prevent contamination of the user when it is being used to clean a predetermined surface area. Such glove includes an flexible portion designed to fit over a wearer's hand. The flexible portion having an inner surface adjacent such wearer's hand and an outer surface. The flexible portion is impervious to passage of predetermined fluids therethrough. There is a predetermined absorbent soft material portion covering at least predetermined portions of an outer surface of such flexible portion.

14 Claims, 5 Drawing Sheets

DISPOSABLE GLOVE

FIELD OF THE INVENTION

The present invention relates, in general, to gloves and, more particularly, this invention relates to a disposable type glove, mitten, or wipe having an inner portion impervious to fluids passing therethrough and an outer absorbent portion for use in cleaning in a variety of situations which includes, but is not limited thereto, unsanitary and biologically hazardous areas.

BACKGROUND OF THE INVENTION

A number of differing types of gloves and wipes have long been known and used for a variety of purposes. Although this invention is not limited thereto one well known area where such items are in widespread use is in the medical field. For example, these items are used extensively in hospital rooms, surgical operating rooms, doctors' offices, nursing homes, nurseries and the like for general clean-up of blood, human waste, body fluids and the like and for bathing infants and elderly persons.

These items are also used to clean-up body fluids, such as blood and fluids of decomposition, at death sites and crime scenes. These scenes can and oftentimes do pose a considerable biological hazard that must be cleaned-up as soon as possible after a death occurs to avoid bio-contamination of surrounding facilities. Either of these tasks can be a most unpleasant effort, not to mention the fact that after clean-up, clothing and in particular the gloves worn, during such clean-up, must be removed and safely discarded without contamination of the wearer, the wearer's hands and surrounding cleaned surfaces.

Since the outer surfaces of such gloves usually become extremely soiled and/or contaminated they must be safely disposed of after the clean-up task. As is generally well known by persons required to use them, these gloves are rather difficult to remove without further contaminating the wearer's hands, arms and/or adjacent area just cleaned. While a first such glove may be relatively easy to remove and thereby expose one clean hand, that clean hand must then be used to remove the other soiled/contaminated glove without soiling or contaminating the clean hand. As mentioned, this task has oftentimes been shown to be rather difficult.

SUMMARY OF THE INVENTION

The present invention provides an improved glove specifically designed to prevent contamination of the user when such glove is being used to clean a predetermined surface area. The glove includes an flexible portion designed to fit over a wearer's hand. Additionally such flexible portion has an inner surface adjacent such wearer's hand and an outer surface. Such flexible portion being impervious to passage of predetermined fluids therethrough. The final essential element of the glove is a predetermined absorbent soft material portion covering at least predetermined portions of an outer surface of such flexible portion.

OBJECTS OF THE INVENTION

Accordingly, it is one of the primary objects of the present invention to provide a new and improved glove, mitten and wipe, or the like, for use in cleaning a variety of objects.

Another object of the present invention is to provide a new and improved glove, mitten and wipe, or the like, which is disposable.

Still another object of the present invention is to provide a new and improved glove, mitten and wipe, or the like, which can be used to clean sanitary type spills, unsanitary and/or biologically hazardous surfaces without having contact with a wearers hand.

Yet another object of the present invention is to provide a new and improved glove, mitten and wipe, or the like, in which at least a portion thereof which comes in contact with the wearers hand is manufactured of a stretchable material and at least a portion of the stretchable material is covered with an absorbent material.

A further object of the present invention is to provide a new and improved glove, mitten and wipe, or the like, which is suitable for the cleansing of the tender skin of both infants and elderly persons.

Still another object of the present invention is to provide a new and improved glove, mitten and wipe, or the like, which is designed to permit quick and easy removal thereof without soiling or contaminating the user's hands or surrounding area.

Yet still another object of the present invention is to provide a new and improved glove, mitten and wipe, or the like, which may include a stretchable sleeve portion that can be stretched inside-out over a soiled/contaminated hand portion for quick and sanitary removal and disposal of the soiled/contaminated glove/mitten.

It is an additional object of the present invention to provide a new and improved glove, mitten and wipe, or the like, which will maximize the use of a user's hand movements during use.

In addition to the several objects and advantages of the present invention which have been described above, it should be understood that various other objects and advantages of this invention will become more readily apparent from the following more detailed description, particularly, when such description is taken in conjunction with the attached drawings and with the appended claims.

Figure 1:
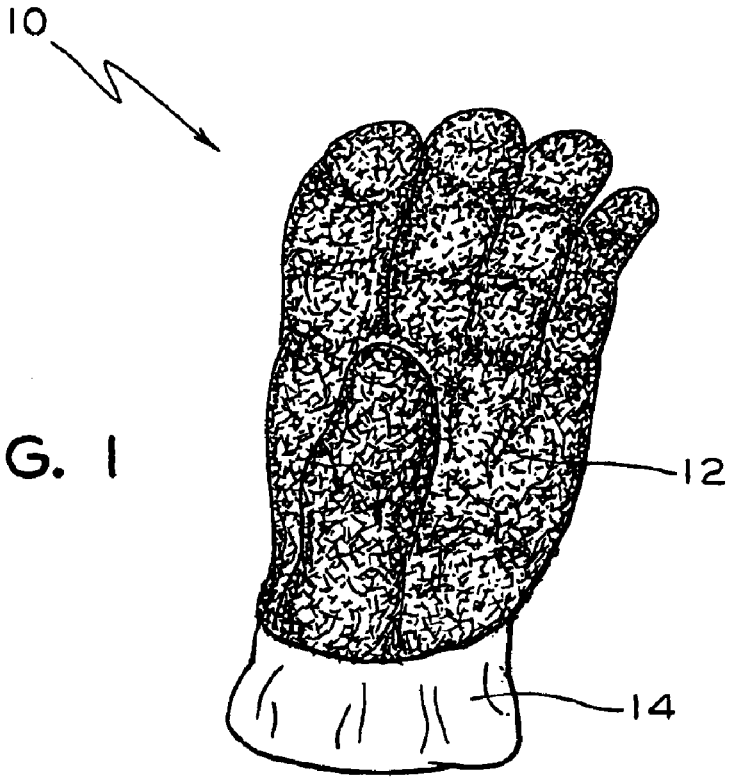
FIG. 1 is a view of an outstretched flexible glove having a partial covering of a soft absorbent material such as cotton overlaying the palm and finger portions of the flexible hand glove.

DESCRIPTION OF THE PRESENTLY PREFERRED AND VARIOUS ALTERNATIVE EMBODIMENTS OF THE PRESENT INVENTION

Prior to proceeding to the more detailed description of the invention it should be noted that for the sake of clarity and understanding of the invention, identical components which have identical functions have been identified with identical reference numerals.

Figure 2:
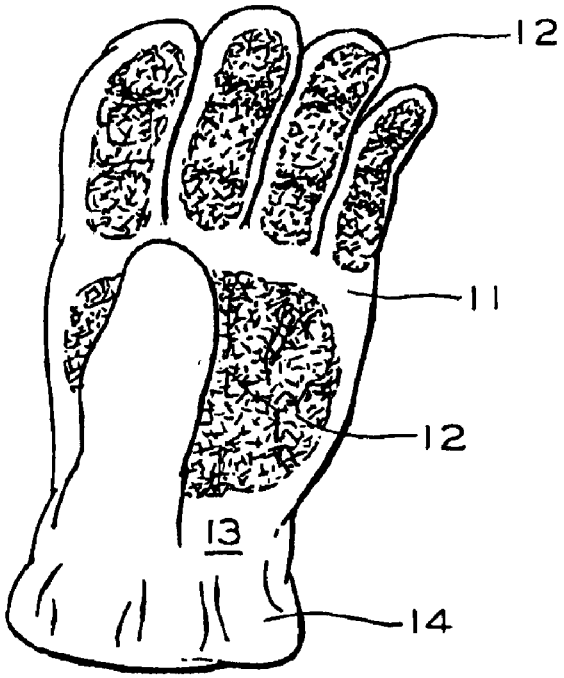
FIG. 2 is a view of a flattened glove according to another embodiment of this invention wherein only palm and finger portions of the flexible glove are covered by the soft and absorbent fabric.

Reference is now made, more particularly, to FIGS. 1 and 2. Illustrated therein is one presently preferred embodiment of this invention which essentially comprises a glove, generally designated as 10. Glove 10 includes an impervious, flexible material 11, such as rubber, plastic or latex. The outer surface 13 of the flexible material 11 is over-laid with a soft, absorbent material 12 such as cotton or terry-cloth.

Although not limited thereto, or thereby, such glove 10 is ideally suited for bathing the tender skin of both infants and elderly persons. The soft, absorbent over-lay 12 can be provided by bonding a conventional flexible material 11 formed as the inner portion of glove 10 within a somewhat oversized cotton or cloth glove, as seen in FIG. 1, or by bonding a hand-shaped layer of cotton onto one or both sides of an flexible glove 10, as best seen in FIG. 2.

Perhaps the best technique for accomplishing this is to spray a plurality of small cotton fibers onto the outer surface 13 of the flexible material 11 of glove 10 which has been covered with an adhesive (not shown) so that each fiber will adhere in place to the flexible material 11 of glove 10 and accordingly permit the glove 10 to stretch.

As for other techniques, it should be appreciated that is not essential, that the full entire outer surface 13 of the flexible material 11 of glove 10 be provided with the soft absorbent fabric or fibers 12, as indeed, one embodiment of this invention, illustrated in FIG. 2, is to provide the flexible material 11 of glove 10 with certain selected areas being covered with a soft absorbent fabric 12. For example, the soft, absorbent fabric 12 is provided as a generally circular patch over the palm portion of the glove 10 and elongated patches over the finger portions. In this regard it should be noted that the scope of this invention also includes mittens and two-fingered gloves wherein obviously much more freedom is provided for selecting the area to be so covered with the soft, absorbent fabric 12.

Figure 3:
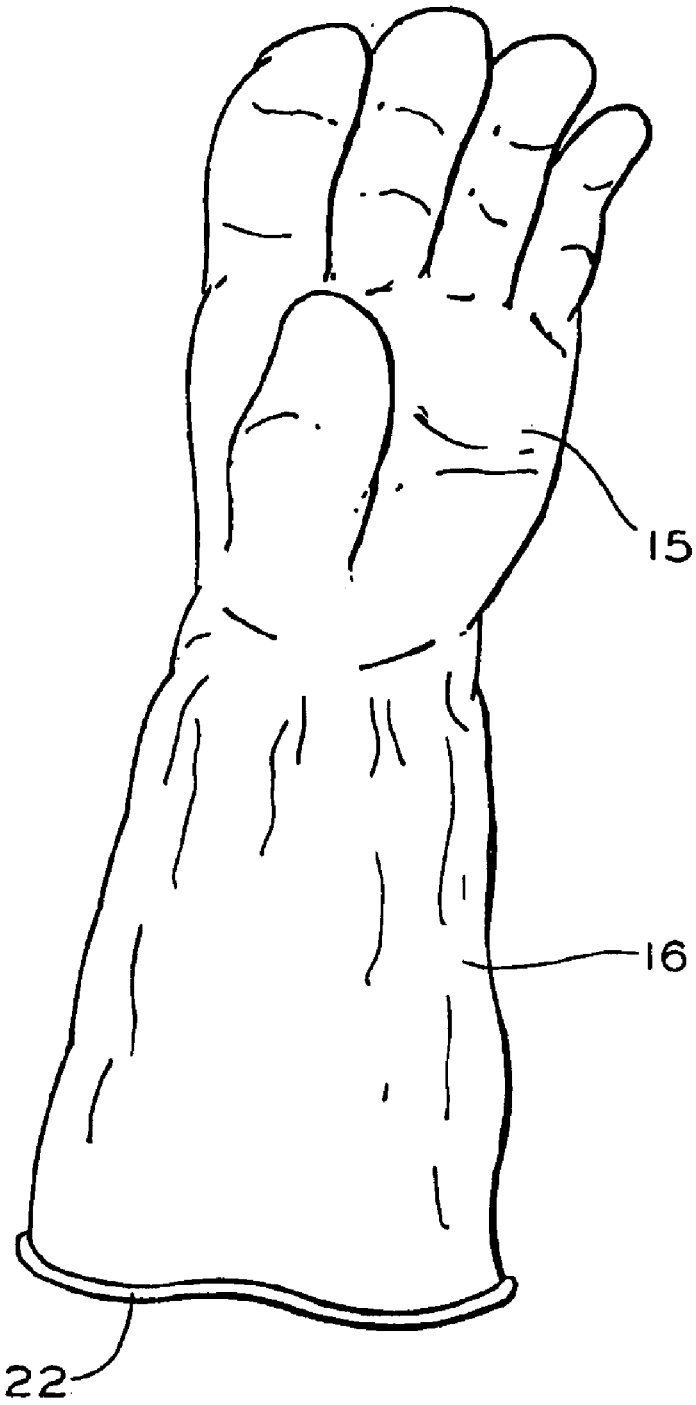
FIG. 3 illustrates a third embodiment of this invention where the flexible glove includes an flexible sleeve portion having a rib encircling the terminal end of the sleeve portion which can easily be grasped to remove the glove.
Figure 4:
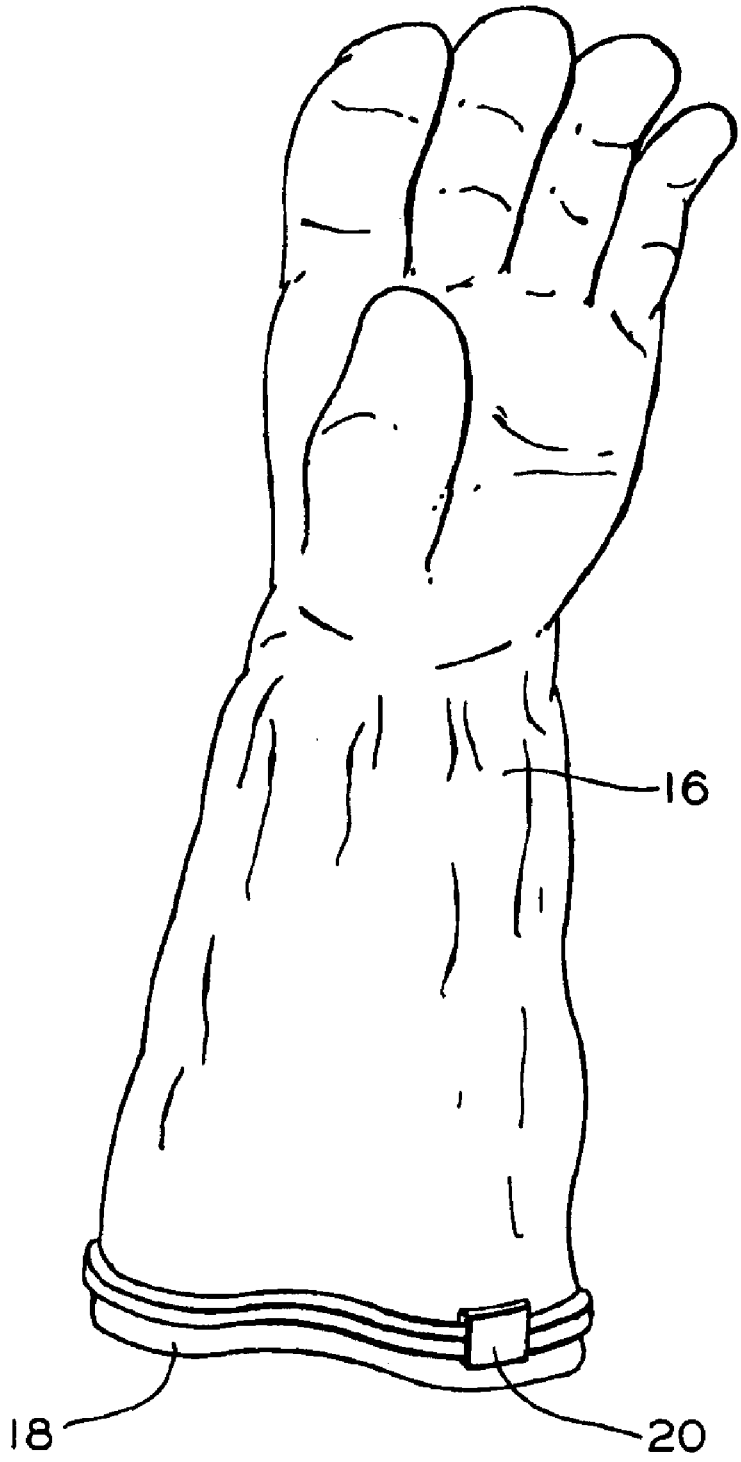
FIG. 4 is substantially the same as FIG. 3 and differs only in replacing a zip-lock arrangement for the rib.
Figure 5:
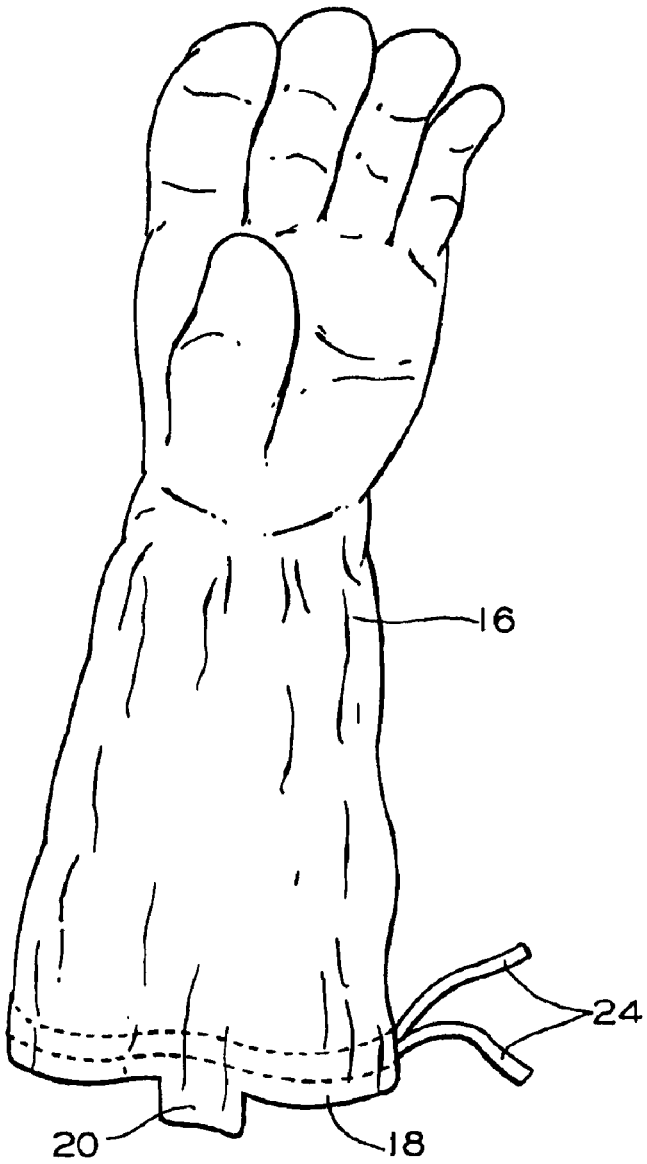
FIG. 5 is substantially the same as FIGS. 3 and 4 and differs in having a pair of ties extending from the terminal end of the sleeve portion of the glove for tie closing the inverted sleeve portion after removal of the glove.
Figure 6:
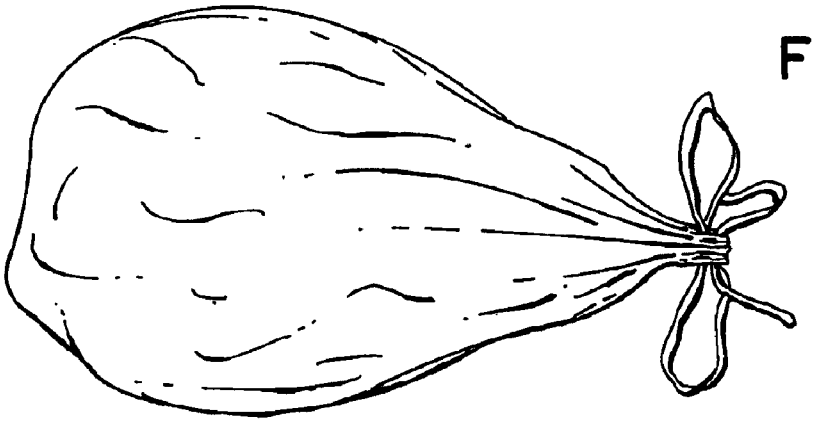
FIG. 6 is substantially the same as FIGS. 3–5 above but depicts the glove after use and removal and sealing of the glove for proper disposal.

In another embodiment of the invention, as illustrated in FIGS. 3–5 such a stretchable glove 10 including the absorbent material over-lay 12, includes a hand covering portion 15 intended to fit over the wearer's hand up to a wrist portion 14 (FIG. 2), a sleeve portion 16 extending from said wrist portion 14 to fit over the wearer's forearm and extending to a terminal end 18 of the sleeve portion 16 between the wrist portion 14 and the wearer's elbow, and at least one gripping means 20 near the terminal end 16 of the sleeve portion 16 for grasping the sleeve portion 16 to remove the glove 10 by stretching the sleeve portion 16 inside-out over any soiled/contaminated areas on the outer surface of the hand portion 12 to thereby remove the glove 10 such that the soiled/contaminated hand portion 15 is maintained completely within the inside-out sleeve portion 16 for quick and easy disposal. In its simplest terms, the gripping means 20 itself may be nothing more than an exposed edge of sleeve portion 16.

While the hand covering portion 15 should ideally fit somewhat tightly over the wearer's hand to permit an optimum ability to grasp and feel, a snug-tight fit is not particularly essential, except to the extent that the hand covering portion 15 should cling tightly enough to permit the sleeve portion 16 to be stretched downwardly there over without permitting the inside-out surface of the sleeve portion 16 to contact the soiled/contaminated outer surface of the hand covering portion 15. In this regard it is realized that the wearer may be able to pinch his/her fingers together tightly enough to permit the stretching action to assure that the soiled/contaminated outer surface of the hand covering portion 15 is drawn into the inside-out sleeve portion 16 when the glove 10 is removed.

The sleeve portion 16, ideally should not be tight fitting over the wearer's forearm, but in fact may even be somewhat fluted in shape towards the elbow, to facilitate stretching the sleeve portion 16 downwardly over the hand covering portion 15. Of course, any fluting of the sleeve portion 16 should be minimized to minimize the possibility of soiling or contaminating the inside surfaces of the sleeve portion 16.

There are a great number of possibilities for the gripping means 20, from a simple rib, encircling the terminal end of the glove 10, as shown in FIG. 3, to a pair of tie strips 24, as shown in FIG. 3, and as noted above may even be the edge of the sleeve portion 16. As suggested above, a choice for the gripping means may depend upon whether the gripping means is to serve the additional function of closing the inside-out sleeve portion 22 after removal thereof. For example, the pair of tie strings 24 as shown in FIG. 5 will serve the added function of sealing the inside-out sleeve portion 22 by merely tying them together around the end of the inside-out sleeve portion 22. Other examples would be to provide a ZIP-LOCK® closure means at the terminal end of the sleeve portion 16, as shown in FIG. 4, or to provide a pair of mating snaps (not shown) or to incorporate a tie-wire (not shown) into the terminal end of the sleeve portion 16.

Figure 7:
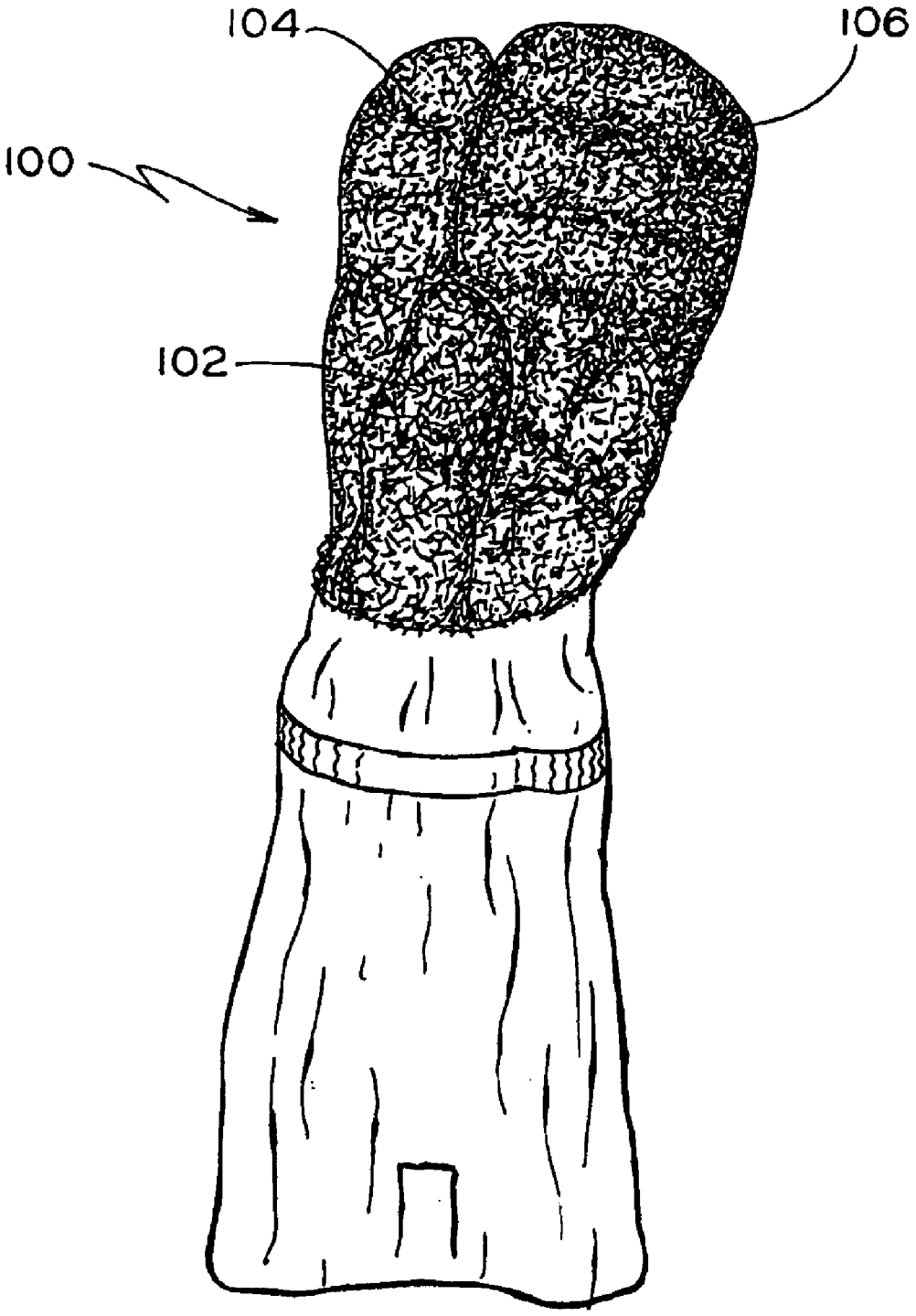
FIG. 7 illustrates still another embodiment of the glove which in certain applications may be a preferred embodiment.

Reference is now made to FIG. 7. Illustrated therein is a glove, generally designated 100, which at least includes a thumb portion 102, an index finger portion 104 and a third portion 106 which may have the middle, ring and little fingers disposable therein.

Having described a number of presently preferred embodiments of this invention, it should be apparent that other embodiments could be utilized and modifications incorporated without departing from the spirit of the invention. For example, a pair of opposed and mating snaps could be provided near the terminal end of sleeve portion for sealing the inside-out sleeve portion for proper disposal. Additionally, a completely independent means not incorporated in the gripping means could be utilized to seal the inside-out sleeve portion, such as conventional wire or plastic ties as used to seal garbage bags, or even a clamp or small length of string. Obviously, therefore, the inventive glove of this invention does not need to include a sealing means or even a gripping means, as one could merely grip the terminal end of sleeve portion to remove the glove and seal it closed with any means available, such as a length of string tied around the opening side of the inside-out sleeve portion, or a length of tape to tape the sleeve portion 14 in a closed and sealed position.

While both a presently preferred and various alternative embodiments of the instant invention have been described in detail above it should be recognized that various other adaptations and modifications of the invention can be envisioned by those persons who are skilled in the art without departing from the either spirit of the invention taught herein or the scope of the appended claims.

We claim:

1. An improved glove specifically designed to prevent contamination of a user when said glove is being used to clean a predetermined surface area, said glove comprising:

(a) a flexible portion selected from the group consisting of rubber, latex, plastic and various combinations thereof designed to fit over a wearer's hand, said flexible portion having an inner surface disposed at least adjacent said wearer's hand and wrist and an outer surface, said flexible portion being impervious to passage of predetermined fluids therethrough;

(b) a predetermined absorbent soft material portion selected from the group consisting of cotton, terry-cloth, tissue and various combinations thereof covering at least predetermined portions of an outer surface of said flexible portion, said at least said predetermined portions of said outer surface of said flexible material at least including a palm and inner finger portions of said glove;

(c) a securing means disposed between and engageable with each of said outer surface of said flexible portion and an inner surface of said absorbent material for securing said absorbent material to said flexible portion, said securing means selected for having a capability of adhering to said inner surface of said absorbent material without impairing its absorbing capability and to said outer surface of said flexible portion without impairing its flexibility; and (d) a gripping means secured to and disposed adjacent an open end of said glove for assisting in removing said glove in an inside out manner, said gripping means including a loop like member.

2. The glove, according to claim 1, wherein said predetermined absorbent soft material is cotton.

3. The glove, according to claim 1, wherein said predetermined portions of said outer surface of said flexible portion having said absorbent soft material is only over selected surface areas of said glove.

4. The glove, according to claim 1, wherein said glove includes a thumb portion, an index finger portion and at least one additional finger portion.

5. The glove, according to claim 1, wherein said glove includes at least one rib portion disposed adjacent a wrist portion of said glove.

6. The glove, according to claim 1, wherein said securing means is a double sided adhesive which will ensure retention of a soft feel to said absorbent material.

7. An improved glove, said glove comprising:

(a) an impervious flexible material selected from the group consisting of rubber, latex, plastic and various combinations thereof having a hand covering portion to fit over a wearer's hand;

(b) a wrist portion selected from the group consisting of rubber, latex, plastic and various combinations thereof connected to and extending from said hand covering portion;

(c) a sleeve portion selected from the group consisting of rubber, latex, plastic and various combinations thereof connected to and extending from said wrist portion to fit over such wearer's forearm and extending to a terminal end between said wrist portion and such wearer's elbow;

(d) at least one loop type gripping means secured to and disposed adjacent said terminal end of said sleeve portion for grasping said sleeve portion to enable removing said glove by stretching said sleeve portion inside-out over any soiled/contaminated areas on an outer surface of said hand covering portion so that said soiled/contaminated hand covering portion is maintained completely within said inside-out sleeve portion for quick and easy disposal;

(e) a predetermined absorbent soft material portion selected from the group consisting of cotton, terry-cloth, tissue and various combinations thereof covering at least predetermined portions of an outer surface of said flexible portion, said at least said predetermined portions of said outer surface of said flexible material at least including a palm and inner finger portions of said glove; and (f) a securing means disposed between and engageable with each of said outer surface of said flexible portion and an inner surface of said absorbent material for securing said absorbent material to said flexible portion, said securing means selected for having a capability of adhering to said inner surface of said absorbent material without impairing its absorbing capability and to said outer surface of said flexible portion without impairing its flexibility.

8. A glove, according to claim 7, wherein said glove further includes a sealing means disposed adjacent said terminal end for sealing said inside-out sleeve portion prior to disposal of said glove.

9. A glove, according to claim 8, wherein said gripping means and said sealing means are formed as a single integrated unit.

10. A glove, according to claim 7, wherein said impervious flexible material is latex rubber.

11. A glove, according to claim 7, wherein said glove is formed as a mitten.

12. A glove, according to claim 7, wherein said absorbent soft material is terry-cloth.

13. A glove, according to claim 12, wherein said terry-cloth is a flap overlaying said hand covering portion.

14. A glove, according to claim 7, wherein said securing means is a double sided adhesive which will ensure retention of a soft feel to said absorbent material.

* * * * *